US006043457A

United States Patent [19]

Hashimoto

[11] Patent Number: 6,043,457

[45] Date of Patent: Mar. 28, 2000

[54] BODY HAIR TREATING IMPLEMENT

[76] Inventor: Kenji Hashimoto, 6-20, Todoroki 7-chome, Setagaya-ku, Tokyo, Japan

[21] Appl. No.: 09/108,237

[22] Filed: Jul. 1, 1998

[30] Foreign Application Priority Data

Jul. 4, 1997 [JP] Japan ..... 9-194908

[51] Int. Cl.[7] ..... A45D 26/00

[52] U.S. Cl. ..... 219/223; 132/118

[58] Field of Search ..... 219/223, 222, 219/240, 242, 541, 225; 132/226, 118, 119.1, 120, 138, 126, 159; 30/30, 34.1; 200/553; 320/111

[56] References Cited

U.S. PATENT DOCUMENTS

| | | | |
|---|---|---|---|
| 1,861,040 | 5/1932 | Williams | 132/118 |
| 3,027,507 | 3/1962 | Hubner | 320/111 |
| 3,093,724 | 6/1963 | Johnson | 132/118 |
| 3,801,766 | 4/1974 | Morrison, Jr. | 200/553 |
| 3,927,684 | 12/1975 | Lam | 132/119.1 |
| 4,020,549 | 5/1977 | Edwards | 30/30 |
| 4,101,756 | 7/1978 | Yamano | 219/222 |
| 4,354,092 | 10/1982 | Manabe et al. | 219/225 |
| 4,857,702 | 8/1989 | Carafo | 219/225 |
| 5,054,199 | 10/1991 | Ogawa et al. | 30/34.1 |
| 5,064,993 | 11/1991 | Hashimoto . | |

FOREIGN PATENT DOCUMENTS 0102289 3/1984 European Pat. Off. .

*Primary Examiner*—Teresa Walberg
*Assistant Examiner*—Quang Van
*Attorney, Agent, or Firm*—Greenblum & Bernstein P.L.C.

[57] ABSTRACT

A body hair treating implement includes a pair of opposed and spaced comb tooth plates and an electrical heating element which is provided between the comb tooth plates and is brought into contact with body hair combed by the comb teeth of the comb tooth plates, so that when the electrical heating element is supplied with the electrical power, the heating element generates heat to burn and cut the body hair in contact therewith. The opposed comb teeth of the opposed comb tooth plates are entirely or partly interconnected at their tip ends in the form of an arch.

4 Claims, 17 Drawing Sheets

10
1
2
3
3a
3c
5
6
7
8
9
C
U 10
11c
11b
11e
11e
11a
11a
11g 10
11c
11b
11e
11f
11i
11a
11w
11
11h
11g 10
11d
11c
11b
11i
11e
11e
11a
13a
11a
13

10
11e
11g
11x
13
11a
11x
11e
11a 10
11e
11a
11b
11e
11c
11d
11i
13
11a

BODY HAIR TREATING IMPLEMENT

BACKGROUND OF THE INVENTION

1. Field of the Invention

The present invention relates to a body hair treating implement which can be advantageously used to cut or dress unwanted body hair of arms or legs, etc., or before one wears a bikini.

2. Description of the Related Art

For instance, if a cutting tool such as scissors or a razor is used to cut unwanted hair before one wears a hi-leg swimsuit or leotard, the tips of the cut hair are sharp due to shear cutting. The sharp tips can easily thrust into clothes of the swimsuit, etc., which he or she wears and protrude out of the clothes or cause the wearer to feel pain upon touching.

The inventor of the present application has proposed a hair treating implement having an electrical heating element which burns and cuts the body hair so as to leave a round tip on the hair (U.S. Pat. No. 5,064,993, EPO 434903, CA 2023908 or AUS 625947).

In this hair treating implement, provision is essentially made of two comb tooth plates which are spaced from one another so that the sides surfaces thereof are opposed to each other, and an electrical heater such as a nichrome wire which is provided between the opposed comb tooth plates and which is in contact with the body hair located between the adjacent comb teeth of the comb tooth plates, so that when the electrical power is supplied to the heater, the heater generates red-heat and burns and-cuts the body hair brought into contact therewith. The body hair which is in contact with the heating wire can be easily burned and cut. The tip edges of the burned and cut hair are not sharp but round, unlike the conventional hair remover using a cutting tool such as a razor or scissors, etc., in which the hair is sheared.

The proposed hair treating implement can be also used as a hair dressing tool in a barber or beauty shop. Namely, the tips of the dressed hair can be rounded, curled or frizzled to obtain a desired hair style by burning and cutting the same using the heating element which is brought into slide-contact therewith.

In the case that the heating element is made of a fine wire such as a nichrome wire, it is possible to provide a heater cartridge (cassette) which can be removably attached to the implement body. Thus, if the heating wire is broken, it can be replaced with a new cartridge.

Means for absorbing an excessive looseness or elongation of the heating wire due to the thermal expansion upon generating heat is provided to tense the heating wire.

An internal power source type in which a dry battery or storage battery is incorporated in the implement body or an external power source type in which an electrical power is supplied through a DC converter from an external commercial power source to which the hair treating implement is connected by a conductor can be used.

If the distance between the opposed comb tooth plates is too small, the nichrome wire as a heating element provided between the comb tooth plates is located so close to the inner surfaces of the comb tooth plates that a heat loss of the comb tooth plates is caused. To prevent this, in general, the distance between the comb tooth plates is set in the range of 5 to 10. The distance of 5 to 10 mm permits the finger tip or other foreign members to easily enter.

Furthermore, in the proposed hair treating implement, the outer shell (plastic mold) of the implement body which is composed of separate parts which can be assembled or disassembled houses therein;

a) an electrical contact piece which is brought into contact with the heater cartridge attached to the implement body to supply the heating element of the heater cartridge with the electrical power from the implement body;

b) a tensing means for tensing the heating element of the heater cartridge attached to the implement body;

c) an operation switch (ON-OFF switch) for the heating element;

d) a connector which can be connected to an external power source to receive the power therefrom; and e) a circuit board (electronic circuit board or electric circuit board) for controlling the power supply.

These elements are electrically connected to each other so as to achieve the respective functions. Thereafter, the separate parts of the outer shell are assembled to complete a product.

However, the incorporation and arrangement of the separate elements a) through e) in the outer shell are troublesome and make the structure of the implement complex. Moreover, the electrical connection of the electrical elements incorporated in the implement body using connecting wires complicates the assembling or manufacturing operation. Consequently, due to the synergistic action or the interaction of the operations, the yield of the parts or products may be reduced or the manufacturing cost may be increased.

From the viewpoint of safety, it is desirable that user's finger tip or other foreign members can not enter the space defined between the opposed comb tooth plates in which the heating element which generates heat when supplied with the electrical power is placed.

SUMMARY OF THE INVENTION

It is the primary object of the present invention to provide a safe hair treating implement in which it is possible to prevent a finger tip or other foreign member from entering the opposed comb tooth plates.

Another object of the present invention is to provide a simple, inexpensive and high-quality hair treating implement in which the assembling operation of the parts can be standardized and no wiring operation is necessary, thus resulting in an increased yield of the parts or products and a reduced manufacturing cost.

According to an aspect of the present invention, there is provided a body hair treating implement including a pair of opposed and spaced comb tooth plates and an electrical heating element which is provided between the comb tooth plates and is brought into contact with body hair combed by the comb teeth of the comb tooth plates, so that when the electrical heating element is supplied with the electrical power, the heating element generates heat to burn and cut the body hair in contact therewith, wherein the opposed comb teeth of the opposed comb tooth plates are entirely or partly interconnected at their tip ends in the form of an arch.

According to another aspect of the present invention, there is provided a body hair treating implement including a pair of opposed and spaced comb tooth plates and an electrical heating element which is provided between the comb tooth plates and is brought into contact with body hair combed by the comb teeth of the comb tooth plates, so that when the electrical heating element is supplied with the electrical power, the heating element generates heat to burn and cut the body hair in contact therewith, wherein the comb teeth of at least one of the opposed comb tooth plates are entirely or partly bent inward at their tip ends toward the corresponding comb teeth of the other comb tooth plate.

The comb tooth plates can be integrally formed as a comb tooth unit which can be detachably attached to an implement body.

According to still another aspect of the present invention, a body hair treating implement includes an electrical heating element which generates heat when energized to burn and cut a body hair in contact therewith, said electrical heating element being made of a removable cartridge which can be detachably attached to an implement body, wherein electrical contact pieces which are brought into contact with the cartridge attached to the implement body to supply the electrical power to the electrical heating element of the removable cartridge from the implement body are provided on a circuit board to be arranged in the implement body and are electrically connected to an electronic circuit of the circuit board.

In an embodiment, a tensing means for tensing the electrical heating element of the removable cartridge attached to the implement body is provided on a circuit board to be arranged in the implement body.

In another embodiment, electrical contact pieces for a power supply switch to select the power supply to the electrical heating element of the removable cartridge are provided on a circuit board to be arranged in the implement body and are electrically connected to an electronic circuit of the circuit board.

In yet another embodiment, a power receiving connector which can be connected to an external power source is provided on a circuit board to be arranged in the implement body and are electrically connected to an electronic circuit of the circuit board.

According to another aspect of the present invention, in a body hair treating implement including an electrical heating element which generates heat when energized to burn and cut a body hair in contact therewith, said electrical heating element being made of a removable cartridge which can be detachably attached to an implement body, at least one of a) electrical contact pieces which come into contact with the removable cartridge attached to the implement body to supply the electrical power to the electrical heating element of the cartridge; b) a tensing means for tensing the electrical heating element of the removable cartridge attached to the implement body; c) electrical switching contact pieces of a power supply ON-OFF switch for the electrical heating element of the removable cartridge attached to the implement body; and d) a power receiving connector which is electrically connected to an external power source is provided on a circuit board to be arranged in the implement body.

In another aspect of the present invention, at least one of a) an electrode member which is adapted to supply the electrical power to the electrical heating element of the cartridge; b) a tensing means for tensing the electrical heating element; c) electrical switching contact pieces of a power supply ON-OFF switch for the electrical heating element; and d) a power receiving connector which is electrically connected to an external power source is provided on a circuit board to be arranged in the implement body.

The heating element can be a heating wire or heating tube which directly or indirectly generates heat when energized to burn and cut the body hair in contact herewith.

The electrical switching contact pieces of the power supply ON-OFF switch for the electrical heating element can be made of two elastic conductors which are supported at the base ends thereof by the circuit board and which can be elastically deformed so that the front ends of the elastic conductors are brought into contact with each other to close a power supply circuit. The elastic conductors are interconnected at the base ends thereof and are provided with longitudinal axes extending in different radial directions with respect to the interconnected base ends thereof.

The present disclosure relates to subject matter contained in Japanese Patent Applications Nos. 09-102485 (filed on Apr. 4, 1997) and 09-194908 (filed on Jul. 4, 1997) which are expressly incorporated herein by reference in their entireties.

BRIEF DESCRIPTION OF THE DRAWINGS

The invention will be described below in detail with reference to the accompanying drawings, in which.

DESCRIPTION OF THE PREFERRED EMBODIMENT

Figures 1A, 1B, 1C, 1D, 1E:
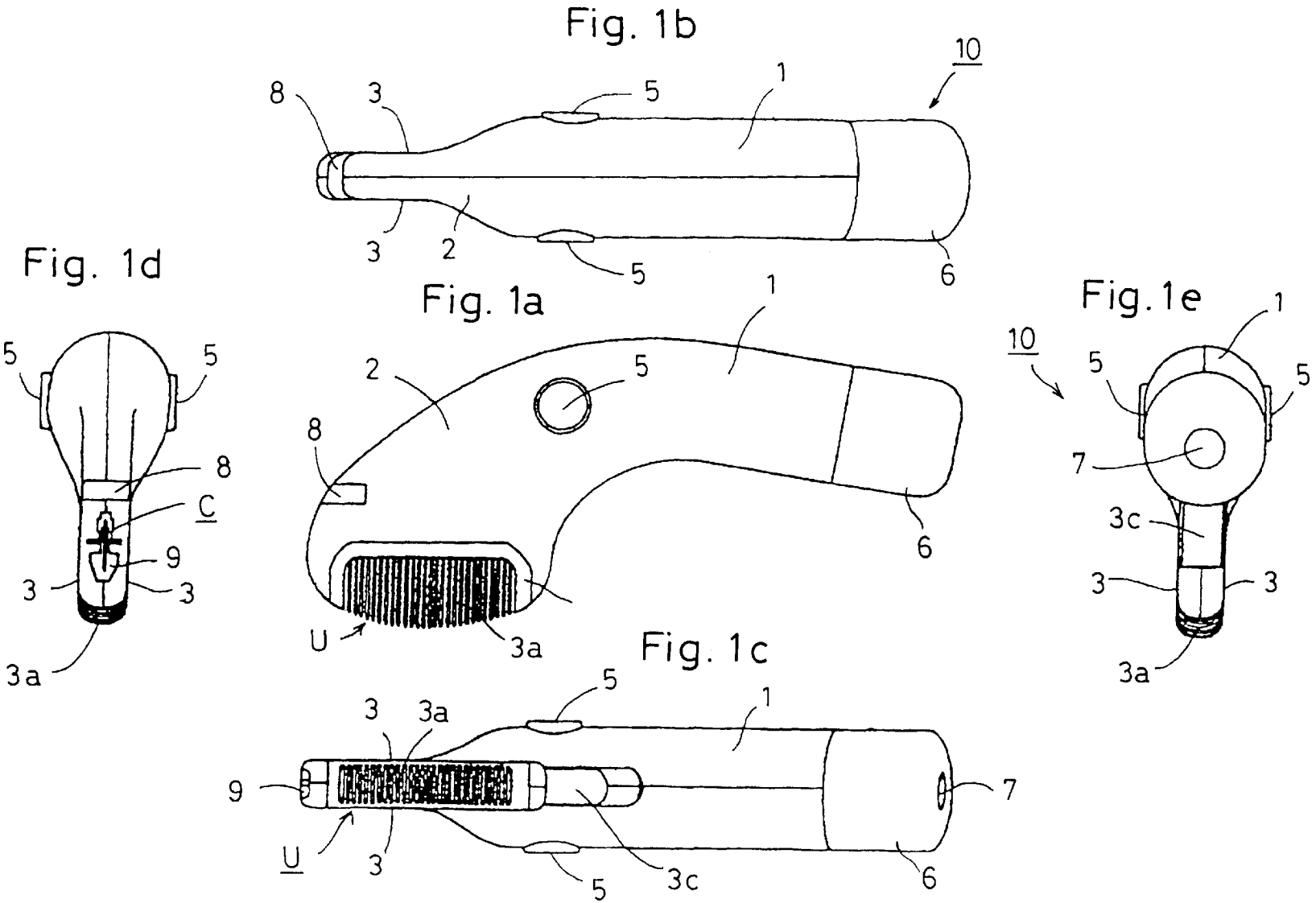
FIGS. 1*a* through 1*e* are a right side view, a plan view, a bottom view, a front elevational view and a back view, of a hair treating implement according to an embodiment of the present invention, respectively.

FIG. 1 (FIGS. 1*a* through 1*e*) through FIG. 4 show a first embodiment of the present invention.

A body hair treating implement 10 is provided with a hand grip 1 (shank portion), a head 2 which is integrally provided at the front end of the hand grip 1, a pair of opposed right and left comb tooth plates 3, 3 which are provided on lateral sides of the head 2, a thin nichrome wire 5 which constitutes an electrical heating element extending in a space w defined between the comb tooth plates 3 and 3 in the longitudinal direction, and two switches 5, 5 in the form of a push button provided on the side portions of the implement body 10 at the junction between the hand grip 1 and the head 2. The hand grip 1 is in the form of a circular cylinder or tube which can be easily held by an operator's one hand. In the illustrated embodiment, the cylindrical hand grip 1 defines therein a battery compartment which receives three SUM-2 batteries connected in series. A plug cap 6 is detachably attached to the rear end of the hand grip 1 to close or open the battery compartment.

A user holds the hand grip 1 with his or her one hand; combs the body hair using the comb teeth of the comb tooth plates 3, 3; brings the nichrome wire 4 as an electrical heating element provided between the comb tooth plates 3, 3 into contact with an appropriate length of the body hair; and depresses one or both of the push button switches 5 and 5 using a thumb or index finger of his or her hand which holds the hand grip 1.

Consequently, the electrical circuit (not shown) for the nichrome wire 4 is closed, so that the electrical power is supplied to the nichrome wire 4 from the batteries accommodated in the hand grip 1. As a result, the nichrome wire 4 generates red-heat immediately, so that the body hair which is in contact with the heating nichrome wire 4 is burned and cut. When the switch 5 is released, the power supply to the nichrome wire 4 is interrupted, so that the temperature of the nichrome wire 4 is rapidly decreased.

In the illustrated embodiment, it is possible to supply the electrical power to the nichrome wire from a commercial power source through a DC converter without loading the batteries in the hand grip 1. To this end, the hand grip 1 is provided on the rear end thereof with a power receiving receptacle 7 in which an output terminal (plug) of the DC converter (not shown) can be inserted. Consequently, when the push button switch 5 is depressed, the electrical power is supplied to the nichrome fine wire 4 provided between the opposed comb tooth plates 3 and 3, so that the nichrome wire 4 generate red-heat. The power supply to the nichrome wire 4 is indicated by an indication lamp 8 made of a light emitting diode or the like.

Figure 2:
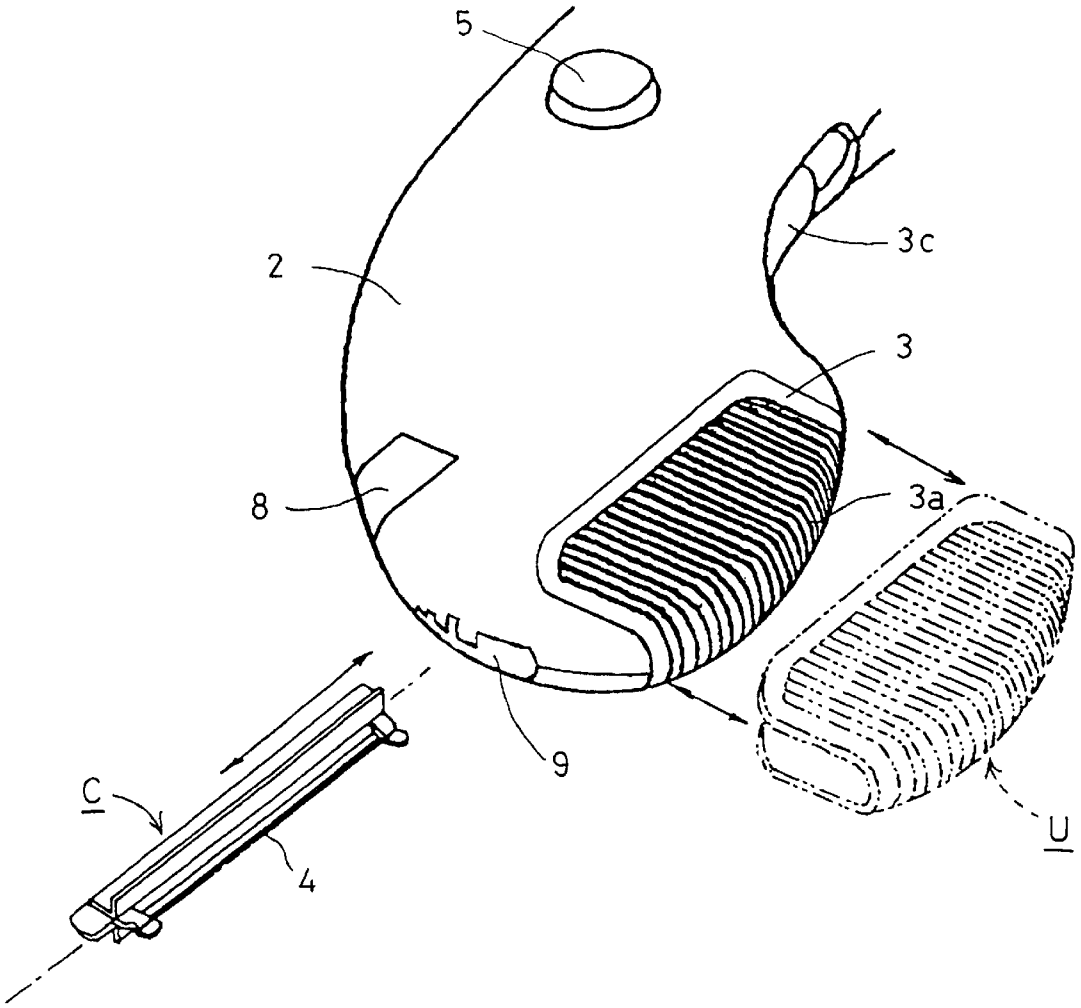
FIG. 2 is an enlarged perspective view of a comb tooth plate of a hair treating implement shown in FIGS. 1*a* through 1*e;*
Figure 3:
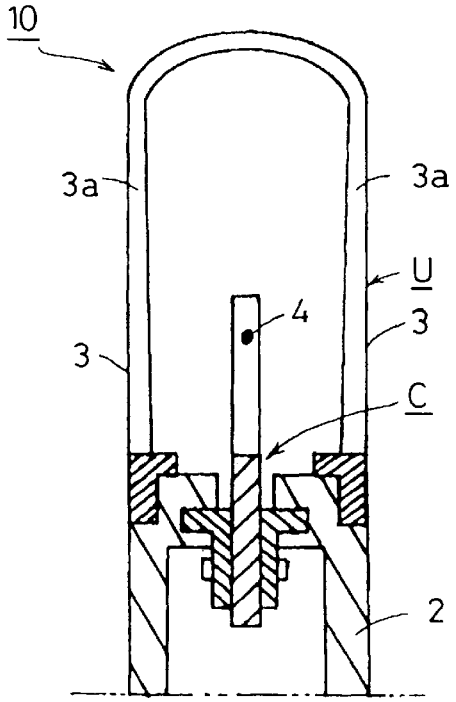
FIG. 3 is an enlarged cross sectional view of a comb tooth plate portion of a hair treating implement shown in FIGS. 1*a* through 1*e;*

Since the heating element is made of a nichrome fine wire, the wire may be broken. If this occurs, it is desirable that the broken wire can be easily replaced. To this end, the nichrome wire 4 is formed as a removable heater cartridge C (FIG. 2) which is detachably attached to the implement body. Thus, when the nichrome wire is broken, the heater cartridge C is replaced with a new heater cartridge. The heater cartridge C is inserted in the head 2 through an insertion opening 9 formed at the front end of the head 2.

When the heater cartridge C is loaded in the implement body, the heater cartridge is electrically connected to a power supply circuit of the implement body. The nichrome wire 4 extends tensely in the longitudinal direction of the implement body between the opposed comb tooth plates 3 and 3.

A heater detachment lever 3*c* is actuated to move the heater cartridge C loaded in the implement body in the direction opposite the attachment (insertion) direction, so that the grip portion of the heater cartridge C is protruded from the insertion opening 9. Consequently, a user who grasps the grip portion of the heater cartridge removes the same from the implement body.

In the illustrated embodiment, the opposed comb tooth plates 3 and 3 are interconnected to form a generally U-shape (in the form of an arch), so that the opposed comb teeth 3*a*, 3*a* are interconnected at the front ends thereof.

Not only can the body hair be easily combed by the arch-shaped comb teeth 3*a*, but also a finger tip or other members cannot enter the space between the comb tooth plates 3 and 3, thus resulting in an enhanced safeness.

In the illustrated embodiment, a comb tooth unit U having the opposed comb tooth plates 3, 3 with the comb teeth 3*a*, 3*a* interconnected at the tip ends thereof in the form of an arch as mentioned above is detachably attached to the head 2 of the implement body.

The head 2 of the implement body is provided with a projection or recess (not shown) which can be engaged by a recess or projection provided on the comb tooth unit U to firmly connect the comb tooth unit U to the head 2. The comb tooth unit U can be detached from the head 2 by disengaging the projection from the recess.

Alternatively it is possible to detachably attach the comb tooth unit U to the head 2 by means of screws, etc. Any detachable attachment of the comb tooth unit can be used.

Owing to the detachable attachment of the comb tooth unit U to the head 2, the comb tooth unit U can be easily washed after it is detached from the head or the comb tooth unit can be easily replaced with a new one when the comb tooth is broken.

The comb tooth plates 3 and 3 or the comb tooth unit U can be molded of heat-resisting plastics, ceramics, or a metal, or the like.

For instance, the comb tooth unit U can be also made of a thin metal plate which is punched so as to have a number of parallel slits and which is thereafter bent into U-shape. It is possible to provide a guide rail for the heater cartridge on the inner surface of the comb tooth unit U.

Figure 4A:
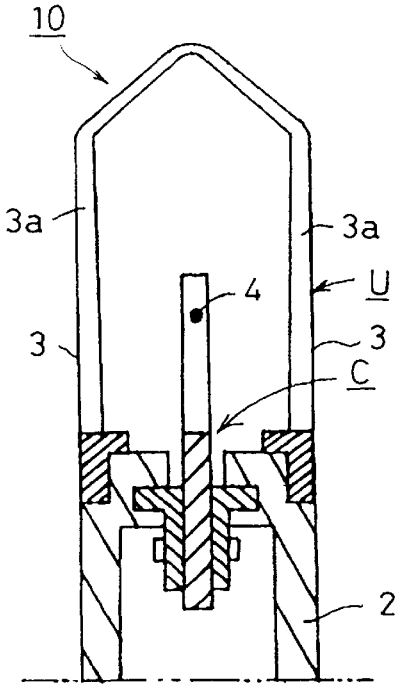
FIGS. 4*a* and 4*b* are enlarged cross sectional-views of two different examples of a comb tooth plate portion of a hair treating implement.
Figure 4B:
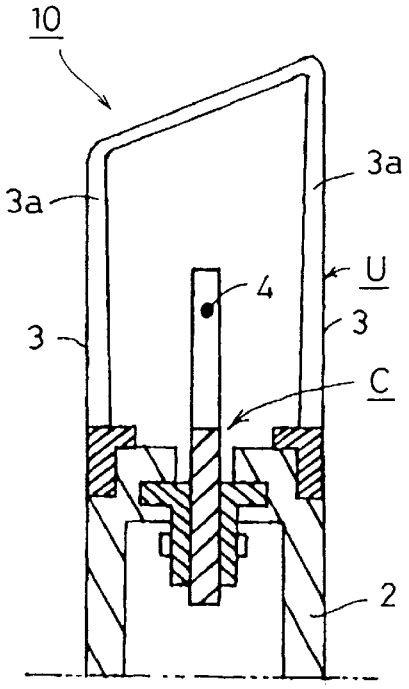
Figure 5:
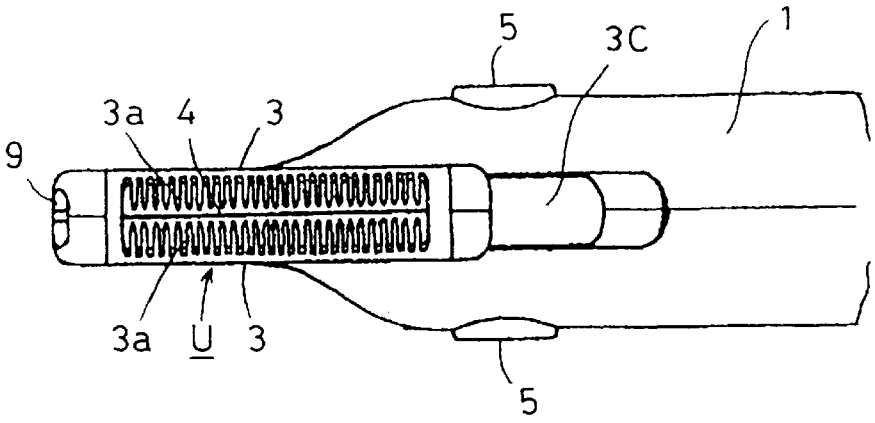
FIG. 5 is a partial bottom view of a hair treating implement according to another embodiment of the present invention.
Figure 6:
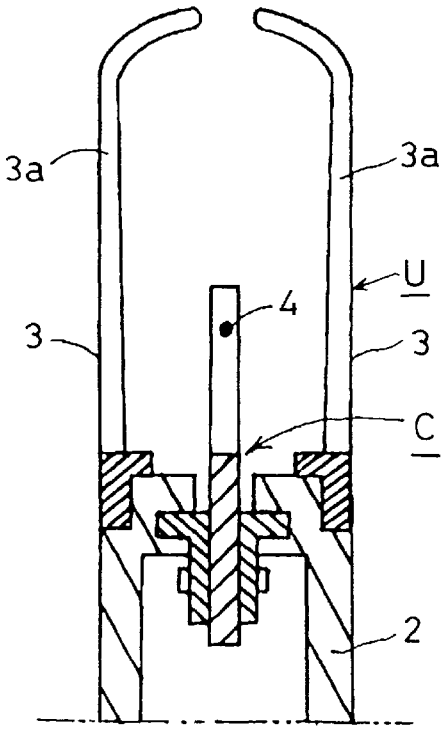
FIG. 6 is an enlarged cross sectional view of a comb tooth plate portion of a hair treating implement shown in FIG. 5.
Figure 7A:
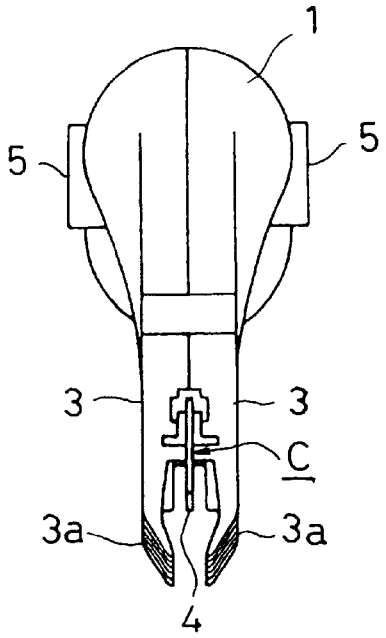
FIGS. 7*a* and 7*b* are back and front views, respectively, of a hair treating implement shown in FIG. 5.
Figure 7B:
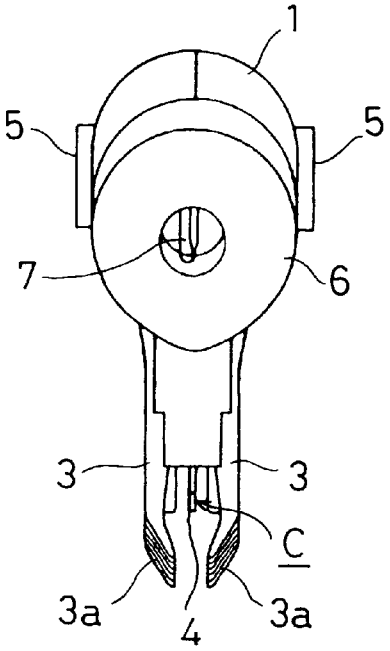

The shape of the comb teeth can be optionally designed. FIGS. 4*a* and 4*b* show two different shapes of the arch comb teeth by way of example.

It is possible to provide arch comb tooth plates whose comb teeth are partly or alternately interconnected.

FIGS. 5 through 8 show a second embodiment of the present invention.

In this embodiment, all the comb teeth 3*a* and 3*a* of the opposed comb tooth plates 3 and 3 are bent inward at the front ends. The distance between the opposed bent front ends of the comb teeth 3*a* and 3*a* is in the range of 0.5 to 1 mm.

Other structure of the hair treating implement in the second embodiment is the same as that of the first embodiment.

In the second embodiment, not only can the body hair be smoothly combed by the comb teeth 3*a* and 3*a* of the opposed comb tooth plates 3 and 3, but also no finger tip or no other foreign member can enter the small space defined between the opposed tips of the comb teeth 3*a* and 3*a* that are bent inward toward each other. Thus, a safe hair treatment implement can be realized.

Figure 8C:
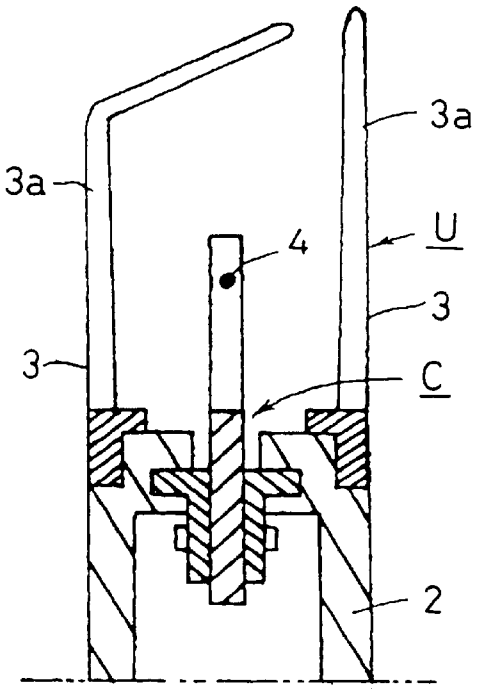
FIGS. 8*a* through 8*c* are enlarged cross sectional views showing three different shapes of a bent tip of a comb tooth plate portion of a hair treating implement shown in FIG. 5.
Figure 8B:
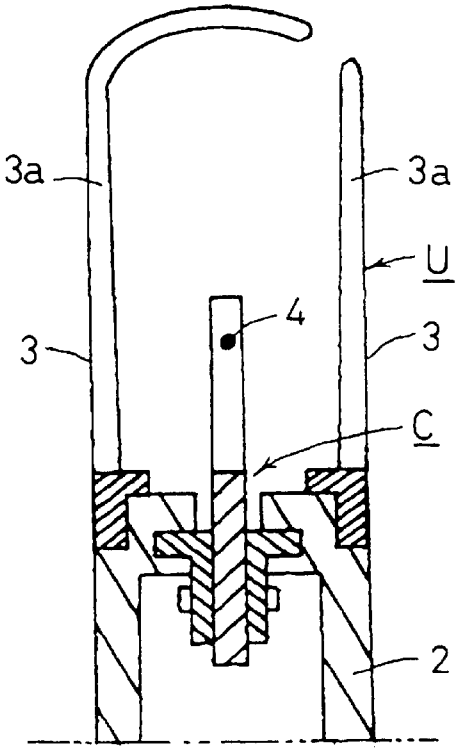
Figure 8A:
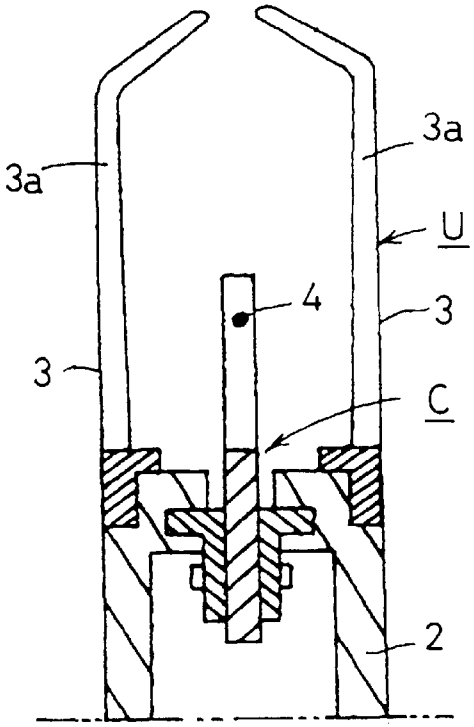
Figures 9A, 9B, 9C, 9D, 9E:
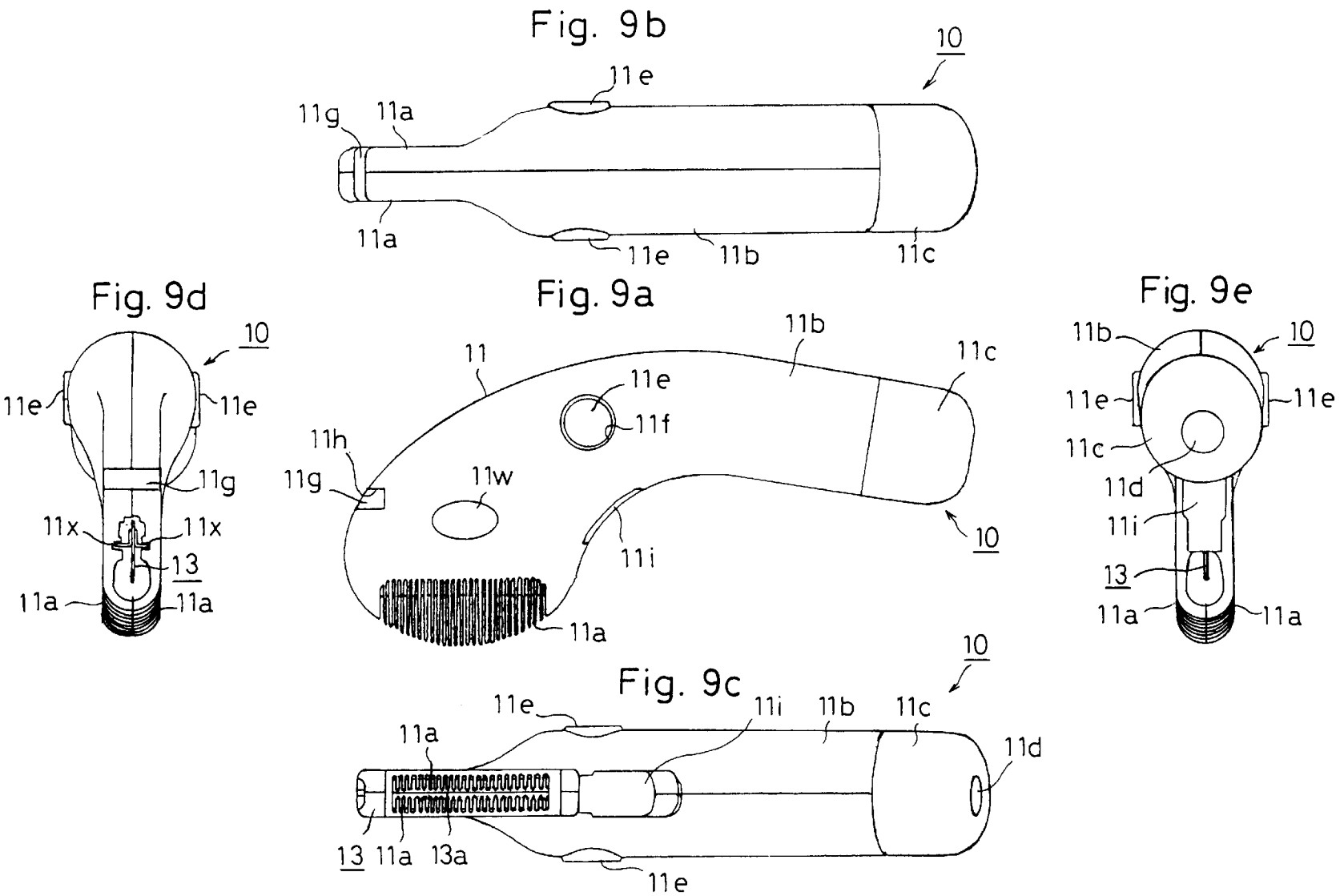
FIGS. 9*a* through 9*e* are a right side view, a plan view, a bottom view, a front elevational view and a back view, of a hair treating implement according to another embodiment of the present invention, respectively.

The shape of the bent ends of the comb teeth 3*a*, 3*a* can be optionally designed. FIGS. 8*a* through 8*c* show three different shapes of the bent ends of the comb teeth by way of example. As can be seen in FIGS. 8*b* or 8*c*, it is possible to bent inward only one of the opposed comb teeth 3*a*, 3*a*.

It is also possible to bent inward only some of the comb teeth of one of the opposed comb tooth plates 3, 3 toward the other comb teeth. Alternatively, it is possible to combine the arch comb teeth in the first embodiment and the comb teeth in the second embodiment.

As can be understood from the above discussion, according to the present embodiments, in a hair treating implement in which the two comb tooth plates are spaced and opposed, and the heating element is provided between the comb tooth plates to come into contact with the hair combed by and placed between the adjacent comb teeth, when the heating element is supplied with the electrical power, it generates red-heat to burn and cut the body hair in contact therewith.

In an embodiment, the tips of all or some of the opposed comb teeth are interconnected in the form of an arch, and hence not only can the body hair be smoothly combed but also the finger tip or other members cannot enter the space between the opposed comb plates. Thus, a safe hair treating implement can be obtained.

In another embodiment, the tips of all or some of the comb teeth of at least one of the opposed comb plates are bent inward toward the corresponding comb teeth. Consequently, the body hair can be smoothly combed and it is possible to prevent the finger tip or other foreign members from entering a space defined between the opposed comb plates. Thus, a safe hair treating implement can be obtained.

In an embodiment, the comb tooth portion having two opposed comb tooth plates is formed as a removable comb tooth unit which can be detachably attached to the implement body. Consequently, not only can the comb tooth unit be easily washed when it is detached from the implement body, but also if the comb tooth is broken, the comb tooth unit can be easily and economically replaced with a new unit.

Still another embodiment of the present invention will be discussed below with reference to FIGS. 9 through 22.

(1) Basic Structure of the Hair Treating Implement

An outer shell 11 of the hollow implement body 11 is molded of heat-resisting plastics, such as ABS resin, polycarbonate resin or delrin resin. The outer shell 11 is composed of a pair of right and left comb tooth plates 11*a*, 11*a* which are bent inward at the front ends as in the first embodiment. The distance between the opposed bent front ends of the comb teeth 11*a* and 11*a* is, for example, in the range of 0.5 to 1 mm. A hand grip 11*b* is formed integral with the rear end of the comb tooth plate 11*a*, and a plug cap 11*c* is provided at the rear ends of the hand grips 11*b*.

A circuit board 12 which will be discussed below in item (2) is incorporated in the implement body 11.

A heater cartridge 13 is inserted in the implement body 11 and between the comb tooth plates 11*a*, 11*a* at the front end thereof. The heater cartridge 13 will be discussed hereinafter in item (3).

Figure 11:
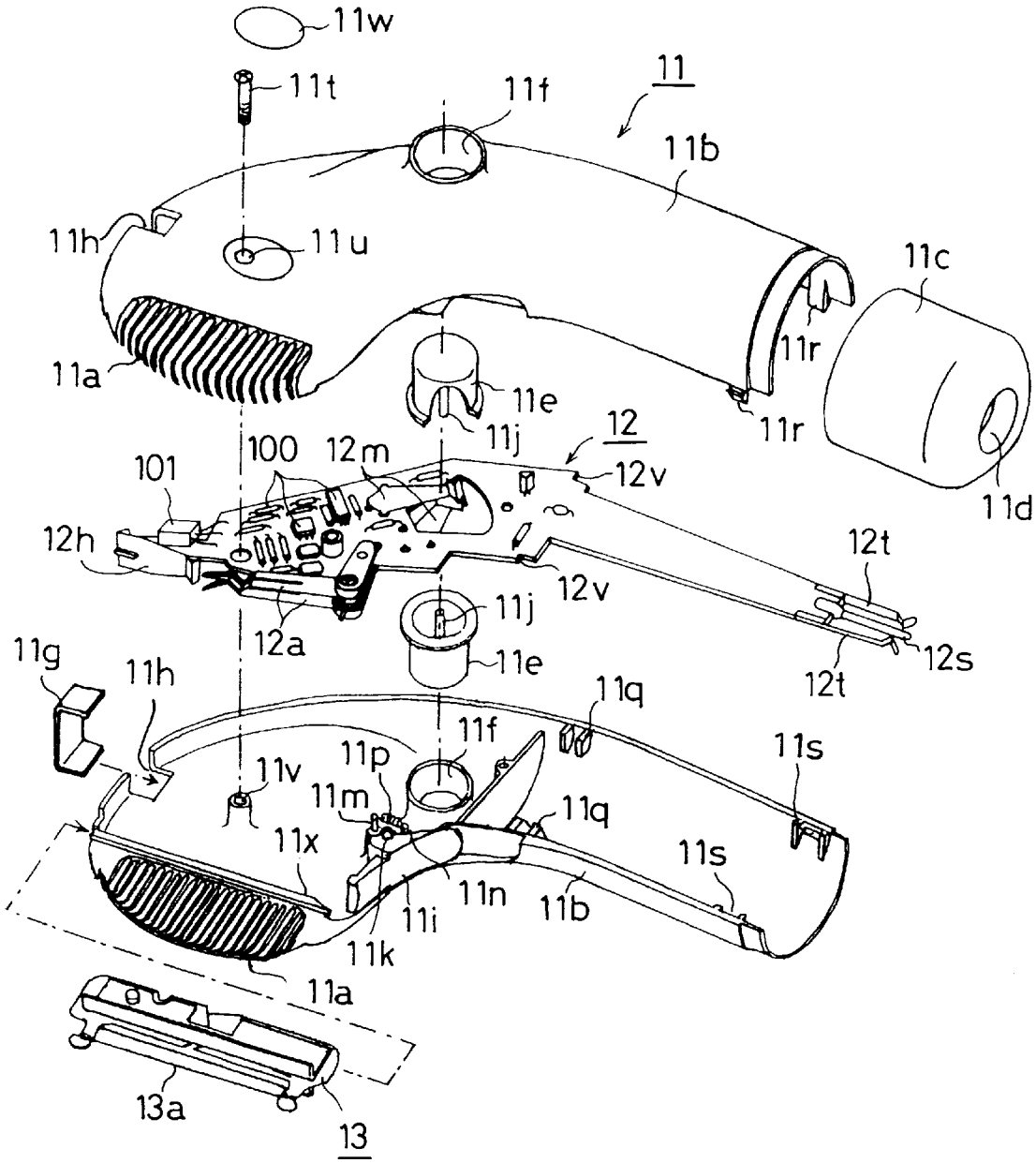
FIG. 11 is an exploded perspective view of an implement body shown in FIG. 10.
Figure 12:
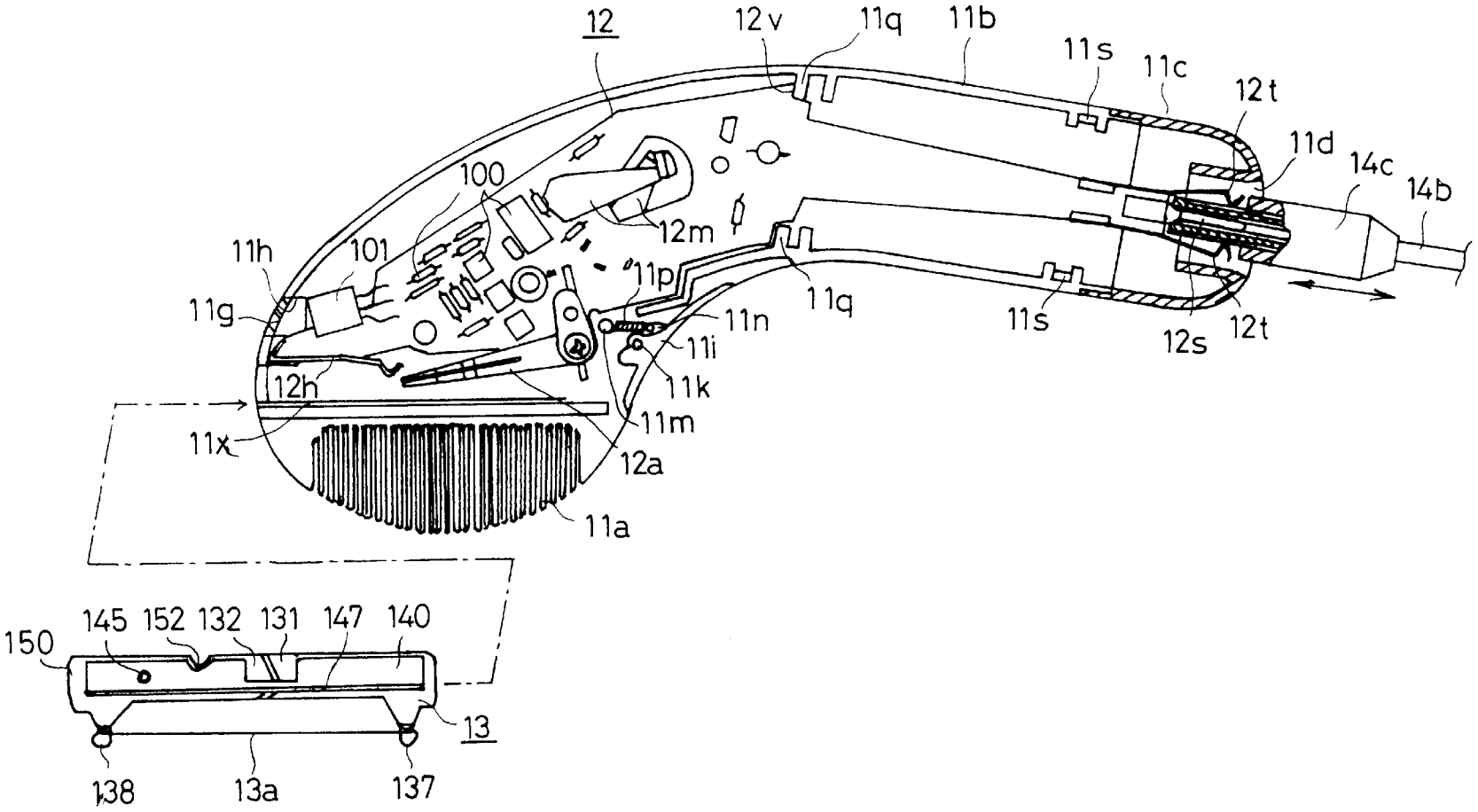
FIG. 12 is a plan view of an internal structure of an implement body shown in FIG. 10.

In the illustrated embodiment, the outer shell 11 is split into two halves which can be connected or disconnected and which are each provided with the comb tooth plate 11*a* and the split hand grip portion 11*b*, as shown in FIG. 11. The two halves of the outer shell are interconnected by the plug cap 11*c* at the rear end of the hand grip 11*b*.

The hand grip 11*b* is in the form of a hollow cylindrical shank of appropriate diameter so as to provide a good feeling upon grasping. The plug cap 11*c* provided at the rear end of the hand grip 11*b* forms a part of the grip portion.

The plug cap 11*c* is provided on the rear end surface thereof with an insertion opening (connector hole) 11*d* in which the plug (power supply connector) 14*c* of the DC converter (FIG. 10) 14 is inserted.

There are two switch buttons 11*e*, 11*e* provided on the opposite sides of the implement body 11 in the vicinity of the base end of the hand grip. The switch buttons 11*e* are internally fitted in corresponding through holes 11*f*, 11*f* formed in the two shell halves 11, as shown in FIG. 11. The switch buttons 11*e* are each provided with a flange 11*j* at the base end thereof, that is adapted to prevent the switch buttons 11*e* from accidentally coming out of the through holes.

A transparent cover 11*g* is attached to an indication lamp opening 11*h* (FIG. 11) formed at the front end surface of the implement body 11. A heater cartridge detachment lever 11*i* is provided in the lower surface of the implement body 11 adjacent the base end of the hand grip.

Figure 10:
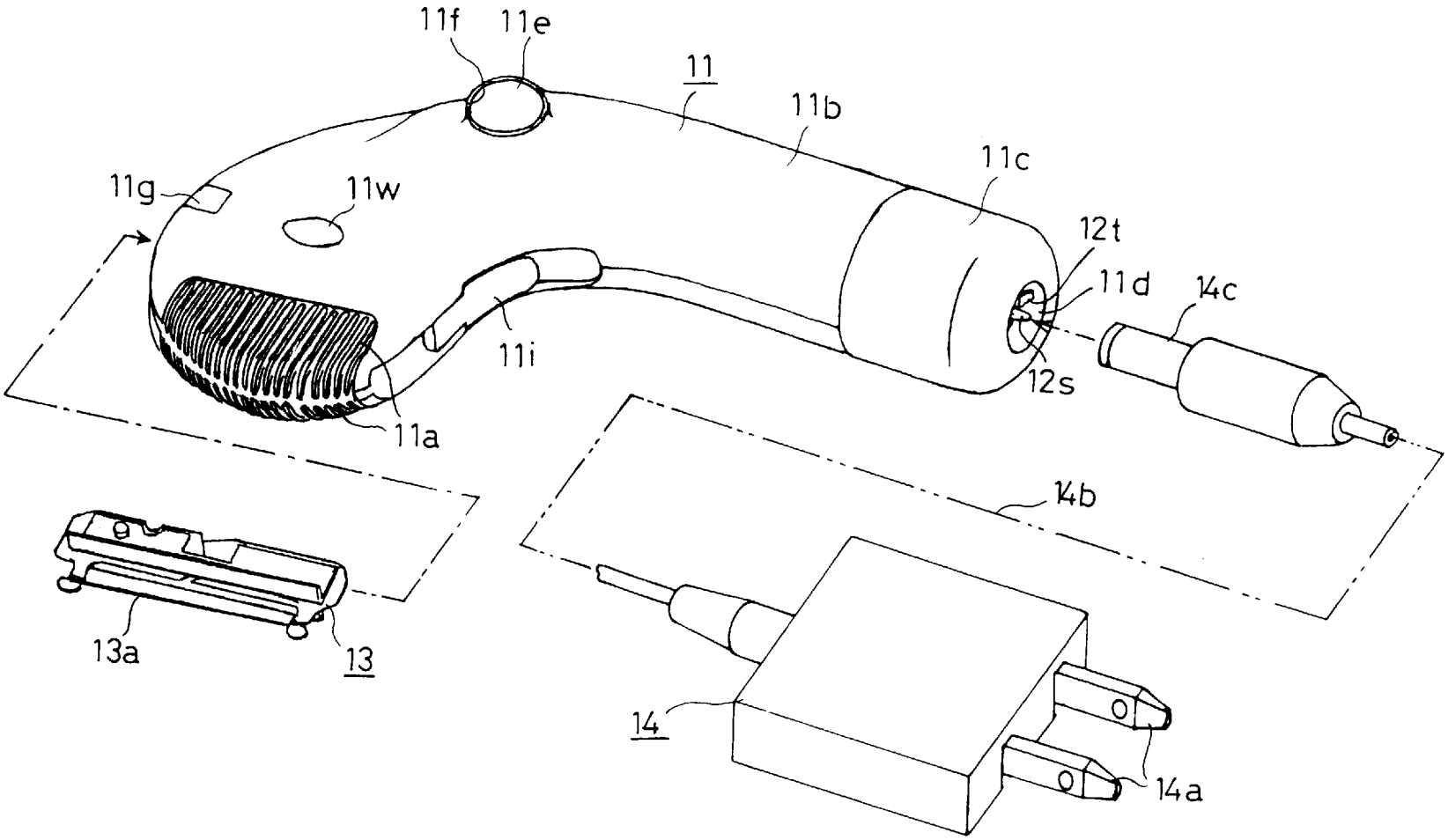
FIG. 10 is a perspective view of an implement body, a heater cartridge and a DC converter shown in FIGS. 9*a* through 9*e;*

In FIG. 10, the input plug 14*a* of the DC converter 14 is inserted in and connected to the receptacle (not shown) of the commercial power source (AC 100V), and the output plug 14*c* of the DC converter 14 is inserted in and connected to the connector hole lid of the plug cap 11*c*. Consequently, the power is supplied to the implement body 11 from the external power source. The DC converter 14 and the output plug 14*c* are connected by an extension cord 14*b*. The heater cartridge 13 is inserted between the comb plates 11*a*, 11*a* from the front end of the comb tooth plates. In this state, when the switch buttons 11*e* are depressed, the power supply circuit of the circuit board 12 is closed so that the power is supplied to the tensed nichrome wire 13*a* of the heater cartridge 13 as an electric heating element, so that the nichrome wire 13*a* generates red-heat.

A user holds the hand grip 11 with his or her hand; combs the body hair using the comb teeth of the comb tooth plates 11*a*; brings the nichrome wire 13*a* of the heater cartridge 13 between the comb tooth plates 11*a* into contact with the body hair; and depresses the push button switches 11*e* using a thumb and an index finger of his or her hand which grasps the hand grip 11*b*. Consequently, the nichrome wire 13*a* generates red-heat. As a result, the body hair in contact with the nichrome wire 13*a* is burned and cut. The tips of the burned and cut hair are not sharp but round, unlike those sheared by a cutting tool. Thus, the drawbacks caused when the hair is sheared by a conventional cutter can be eliminated in the present embodiment.

The heating nichrome wire 13*a* is protected by the comb tooth plates 11*a* on opposite sides of the nichrome wire 13*a*, and hence there is no fear that the nichrome wire 13*a* directly contacts with the user's skin.

(2) Circuit Board 12 and Assembling of the Implement Body 10

Figure 14:
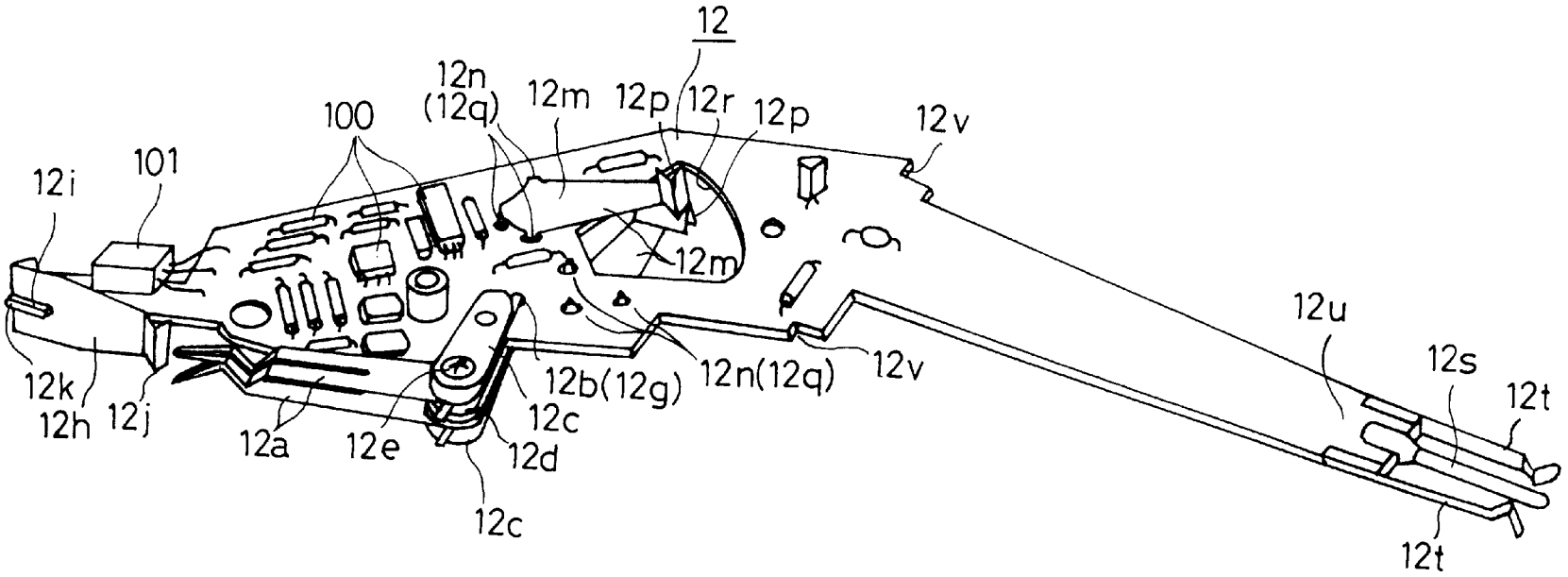
FIG. 14 is a perspective view of a circuit board.
Figure 15:
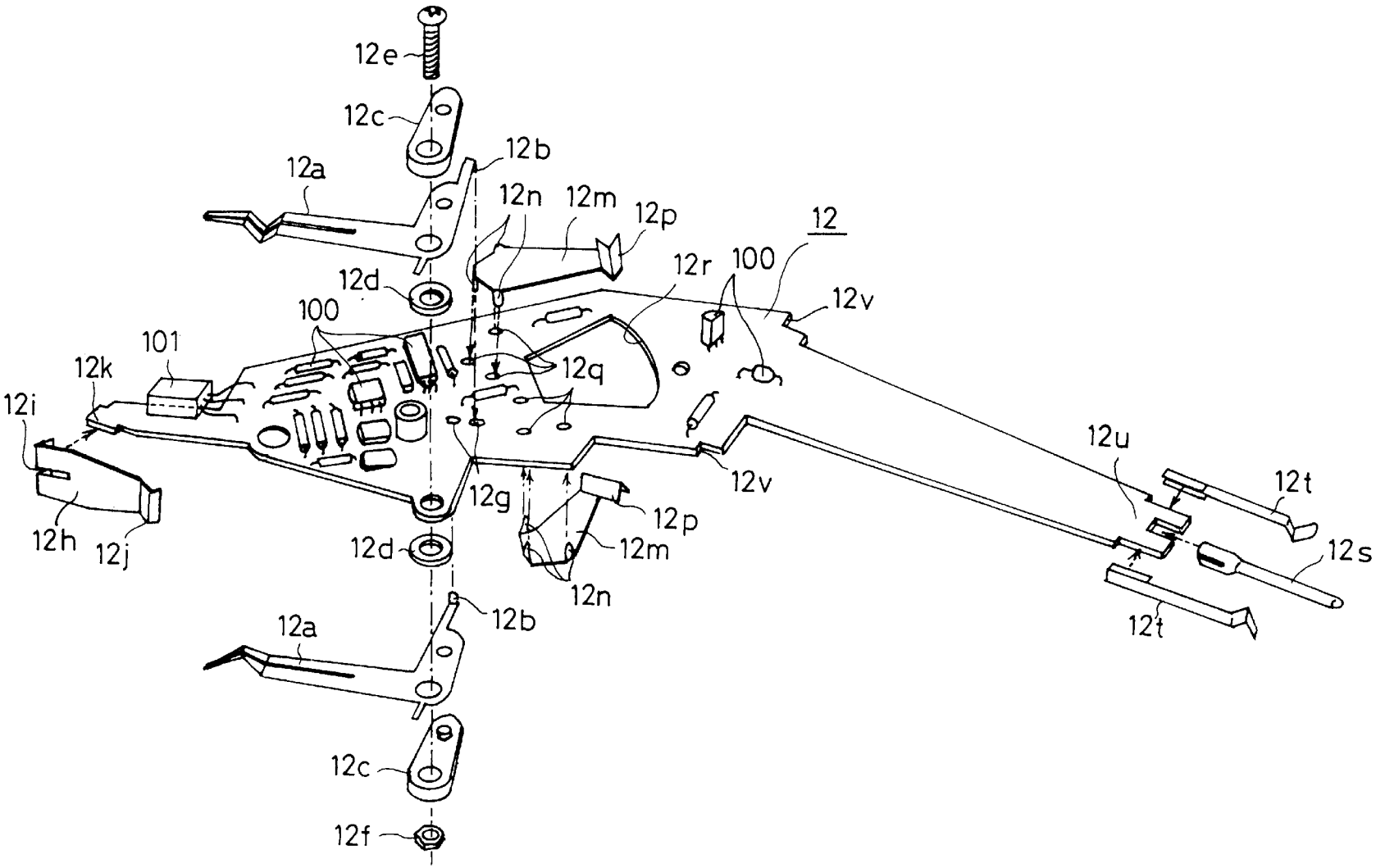
FIG. 15 is an exploded perspective view of a circuit board.

The circuit board 12 will be explained below with reference to FIGS. 14 and 15. The circuit board 12 is adapted to control the power supply to the nichrome fine wire 13*a* as an electrical heating element.

In the illustrated embodiment, the circuit board 12 is made of a printed circuit board having a predetermined shape of an insulated planar substrate which is provided thereon with a predetermined conductor pattern. Electric elements 100 (transistors, diodes, resistors, condensers, LED, etc.) are arranged on the substrate and are soldered to the conductor pattern to provide desired functions. For clarity, the conductor pattern is not shown in the drawings.

The electronic circuit of the circuit board 12 has the following electric functions.

a) power supply function to supply the nichrome wire 13*a* with the electric power at predetermined values of voltage and current when the switches 11*e* are depressed to close the electric circuit;

b) timer function to automatically stop the power supply to the nichrome wire 13*a* when a predetermined time in which the push button switches 11*e* are continuously depressed to continue supplying the power buttons from the commencement of the power supply has lapsed, e.g., after the lapse of 30 to 50 seconds;

c) state indication function to indicate that the power is supplied to the nichrome wire 13*a* in the power supply function a) and that the power supply to the nichrome wire 13*a* has been automatically stopped in the timer function b), in order to warn the user, by controlling the light emission state of the light emitting diode (LED) 101 as an indication lamp.

It is possible to prevent an overheating of the nichrome wire 13*a* which is caused when the power supply thereto continues for a time above a predetermined time, by the timer function b). If the power supply to the nichrome wire 13*a* is automatically stopped in the timer function b), it is possible to restart the power supply to the nichrome wire 13*a* by depressing the push button switches 11*e* again to reset the power supply function.

The light emitting diode 101 as an indication lamp in the indication function c) faces the opening 11*h* formed at the front end of the implement body 11. The opening 11*h* is covered by a transparent cover 11*g* through which the lighting state of the LED 101 can be viewed.

The circuit board 12 is provided thereon with the following elements.

a) electrical contact pieces 12*a*, 12*a* which come into contact with the heater cartridge 13 attached to the implement body 11 to supply the electrical power to the nichrome wire 13*a* of the heater cartridge;

b) tensing spring 12*h* for tensing the nichrome wire 13*a* of the heater cartridge 13 attached to the implement body 11;

c) electrical switching contact pieces 12*m*, 12*m* of a power supply ON-OFF switch for the nichrome wire 13*a* of the heater cartridge 13 attached to the implement body 11; and d) power receiving connectors 12*s* and 12*t* electrically connected to the external power source.

The electrical contact pieces 12*a*, 12*a* are made of punched metal leaf springs which are held at the base ends thereof between insulating supports 12*c* and insulating washers 12*d* and which are opposed to the side surfaces of the circuit board 12. The contact pieces 12*a*, 12*a* are secured to the circuit board 12 by means of screws 12*e* and nuts 12*f*.

The contact pieces 12*a*, 12*a* are provided at the base ends thereof with terminals 12*b* which are formed by bending the contact pieces inwardly. When the contact pieces 12*a*, 12*a* are secured to the circuit board 11, the inwardly bent terminals 12*b* are inserted in and soldered to corresponding insertion holes 12*g* formed in the circuit board 12, so that the contact pieces 12*a*, 12*a* are electrically connected to an electronic circuit of the circuit board 12.

The insulating supports 12*c* and the insulating washers 12*d* are made of an electrically insulating material. In the illustrated embodiment, they are molded of polycarbonate plastics.

The contact pieces 12*a*, 12*a* are elastically brought into contact at their front ends with electrode portions of the heater cartridge 13 attached to the implement body 11 on the opposite sides thereof to establish an electrical connection therebetween.

The shape of the contact pieces 12*a*, 12*a* and the mounting thereof to the circuit board 12 are not limited to those of the illustrated embodiment.

The tensing spring 12*h* is formed by punching a metal sheet into a predetermined shape of leaf spring. The leaf spring 12*h* is provided with an angle hole 12*i* in which the front end 12*k* of the circuit board 12 is perpendicularly engaged, so that the leaf spring 12*h* can be mounted to and held by the front end of the circuit board 12.

The leaf spring 12*h* comes into elastic contact with a movable support (rear substrate 132) of the nichrome wire 13*a* of the heater cartridge 13 attached to the implement body 11 at the front end 12*j* of the leaf spring 12*h* to provide a sufficient tensile force to the nichrome wire 13*a*.

The tensing spring 12*h* is not limited to the leaf spring in the illustrated embodiment and can be of any other type of springs.

The identical switching contact pieces (elastic conductors) 12*m*, 12*m* of the power supply ON-OFF switch are formed by punching a metal sheet. The contact pieces 12*m*, 12*m* are placed on opposite sides of the circuit board 12 and are each provided at the base end portions thereof with three terminals 12*n* which are bent inward toward the circuit board 12. The bent terminals 12*n* are inserted in and soldered to corresponding insertion holes 12*q* formed in the circuit board 12. Consequently, the contact pieces 12*m*, 12*m* are electrically connected to the electronic circuit of the circuit board 12 and are secured to the circuit board 12.

The contact pieces 12*m*, 12*m* are opposed to each other at the front ends 12*p*, 12*p* through an opening 12*r* formed in the circuit board 12. The front ends 12*q*, 12*q* are spaced in a free state, so that the power supply circuit of the circuit board 12 is open (i.e., the power supply circuit is OFF).

The front ends of the central rod portions 11*j*, 11*j* (FIG. 11) provided in the switch buttons 11*e*, 11*e* are in soft contact with the neck portions (base portions of the front ends 12*p*) of the contact pieces 12*m*, 12*m*, respectively. Therefore, when the switch buttons 11*e* are depressed by operator's fingers, the contact pieces 12*m*, 12*m* are elastically deformed close to each other by the front ends of the rod portions 11*j*, 11*j*. Consequently, the contact pieces 12*m*, 12*m* are brought into contact with each other at the front ends 12*p*, 12*p*, so that the power supply circuit of the circuit board 12 is closed (turned ON). If the switch buttons 11*e* are released, the contact pieces 12*m*, 12*m* are returned to the initial position due to the elastic restoring force, so that the front ends 12*p*, 12*p* are disconnected from one another. Thus, the electronic circuit of the circuit board 12 is turned OFF.

Since the contact pieces 12*m*, 12*m* are connected to each other at the front ends 12*p* thereof to close the power supply circuit when any one (or both) of the push button switches 11*e*, 11*e* is depressed, it is not necessary for the operator to focus his or her attention upon selection of the push button switches 11*e*, 11*e*.

Figure 16:
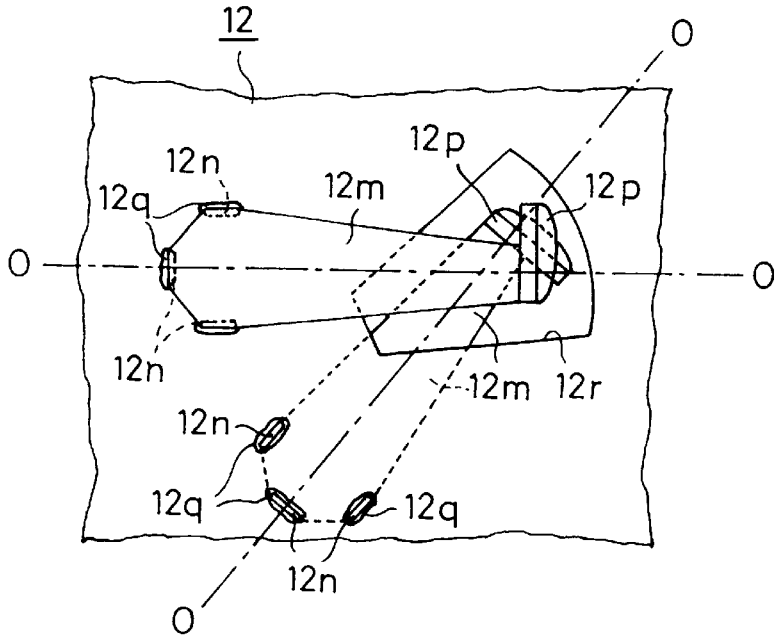
FIG. 16 is an enlarged schematic plan view of two electrical contact pieces.
Figure 17:
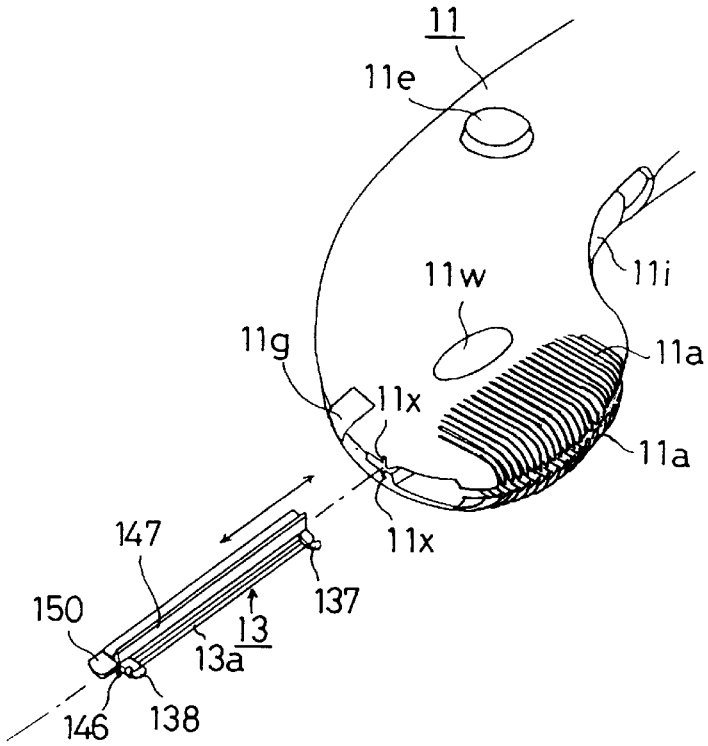
FIG. 17 is a perspective view of a heater cartridge to be attached to an implement body.

In the illustrated embodiment, as may be seen in FIG. 16, the contact pieces 12*m*, 12*m* are attached to the circuit board 12 in such a way that the longitudinal center axes O—O of the contact pieces define a predetermined angle, i.e., extend in different radial directions with respect to the front ends 12*p* of the contact pieces. With this arrangement, the durability of the switches which are repetitively turned ON and OFF can be enhanced.

The shape and the mounting mechanism of the push button switches 11*e*, 11*e* or the electrical contact pieces 12*m*, 12*m* are not limited to those in the illustrated embodiment.

The power receiving connectors 12*s* and 12*t* which can be electrically connected to the external power source are respectively made of a pin electrode 12*s* which extends outward from the rear end 12*u* of the circuit board 12 and a pair of parallel leaf spring electrodes 12*t*, 12*t* provided on opposite sides of the pin electrode 12*s*. The pin electrode 12*s* is soldered and secured at its base end to the circuit board 12 and is electrically connected to the electronic circuit of the circuit board.

The connectors 12*s* and 12*t* are placed in the connector hole 11*d* formed at the rear end of the plug cap 11*c* when the implement body is assembled. When the output plug 14*c* of the DC converter 14 (FIG. 10) is inserted in the connector hole lid, the pin electrode 12*s* is fitted in the inner cylindrical electrode of the output plug 14*c* and the leaf spring electrodes 12*t* are elastically brought into contact with the outer cylindrical electrode surface of the output plug 14*c*. Thus, the electrical power can be supplied to the implement body 11 from the external power source.

The shape and structure, etc., of the connectors 12*s* and 12*t* which can be electrically connected to the external power source are not limited to those in the illustrated embodiment.

The assembling operation of the implement body 11 will be discussed below with reference to FIG. 11.

1) The heater cartridge removing lever 11*i* is rotatably attached to one (first outer shell half) of the two halves of the outer shell of the implement body by fitting the post 11*k* provided on the outer shell half into the shaft hole formed in the heater removing lever 11*i*. Thereafter, the coil spring 11*p* is provided between a spring abutment pin 11*m* provided on the outer shell half and a spring abutment pin 11*n* provided on the lever 11*i*. Consequently, the lever 11*i* is continuously biased to rotate in the counterclockwise direction in FIG. 12 about the axis of the post 11*k* due to the spring force of the coil spring 11*p*. The switch button 11*e* is internally fitted in the through hole 11*f* for the switch button formed in the outer shell half.

2) The circuit board 12 which is provided thereon with the above-mentioned components a) through d), i.e., 12*a*, 12*a*, 12*h*, 12*m*, 12*m*, 12*s* and 12*t* is placed on the outer shell half which is provided thereon with the lever 11*i* and the switch button 11*e* so that positioning members 12*v*, 12*v* provided on the circuit board 12 are engaged in corresponding positioning members 11*q* provided on the outer shell half.

3) The other outer shell half (second outer shell half) which is provided with the switch button 11*e* internally fitted in the through hole 11*f* thereof is superimposed on the first outer shell half which is provided thereon with the lever 11*i*, the switch button 11*e* and the circuit board 12, so that the hooks 11*r* provided on the second outer shell half are engaged by corresponding engaging members 11*s* provided on the first outer shell half. Thereafter, the two halves 11 are integrally connected by a fastening screw 11*t*. As shown in FIG. 11, a screw insertion hole 11*u* is formed in the second outer shell half and a threaded hole 11*v* is formed in the first outer shell half, so that the screw 11*t* can be screwed in the threaded hole 11*v* through the insertion hole 11*u*.

4) The plug cap 11*c* is fitted to the rear end of the hand grip 11*b* constituted by the two outer shell halves. In the illustrated embodiment, the plug cap 11*c* can be detachably attached to the rear end of the hand grip 11*b* by means of a bayonet connector (combination of a groove and a projection). The transparent cover 11*g* is attached to the indication lamp window 11*h* formed at the front end surface of the assembly of the two halves to cover the same.

In the illustrated embodiment, a decorative seal 11*w* is attached to the second outer shell half to cover the head of the screw 11*t* inserted in the insertion hole 11*u* of the second outer shell half, so that the head of the screw 11*t* which would be otherwise exposed to the outside cannot be seen from outside.

The assembling of the implement body 11 is completed by the assembling operations 1) through 4).

Thus, the electrical contact pieces 12*a*, 12*a* which are adapted to supply the power to the electrical heating element 13*a*, the tensing spring 12*h* for tensing the electrical heating element, the electrical switching contact pieces 12*m*, 12*m* for switching the power supply to the electrical heating element, the power receiving connectors 12*s* and 12*t* which can be connected to the external power source are provided on the circuit board 12 to be arranged in the implement body. Consequently, when the circuit board 12 is arranged in the implement body, all the above mentioned components, i.e., the electrical contact pieces 12*a*, 12*a*, the tensing means 12*h*, the electrical switching contact pieces 12*m*, 12*m*, and the power receiving connectors 12*s* and 12*t* can be arranged together in the implement body. Therefore, no individual arrangements or incorporation or wiring of the internal components is necessary. Also, there is no wiring error.

Namely, the assembling operation or the wiring operation can be simplified, and thus not only can the yield of the parts or products be increased, but also the manufacturing cost can be reduced. Consequently, the high quality and inexpensive products can be produced.

(3) Heater Cartridge 13

The heater cartridge 13 will be discussed below, chiefly referring to FIGS. 17 through 21.

Figure 18:
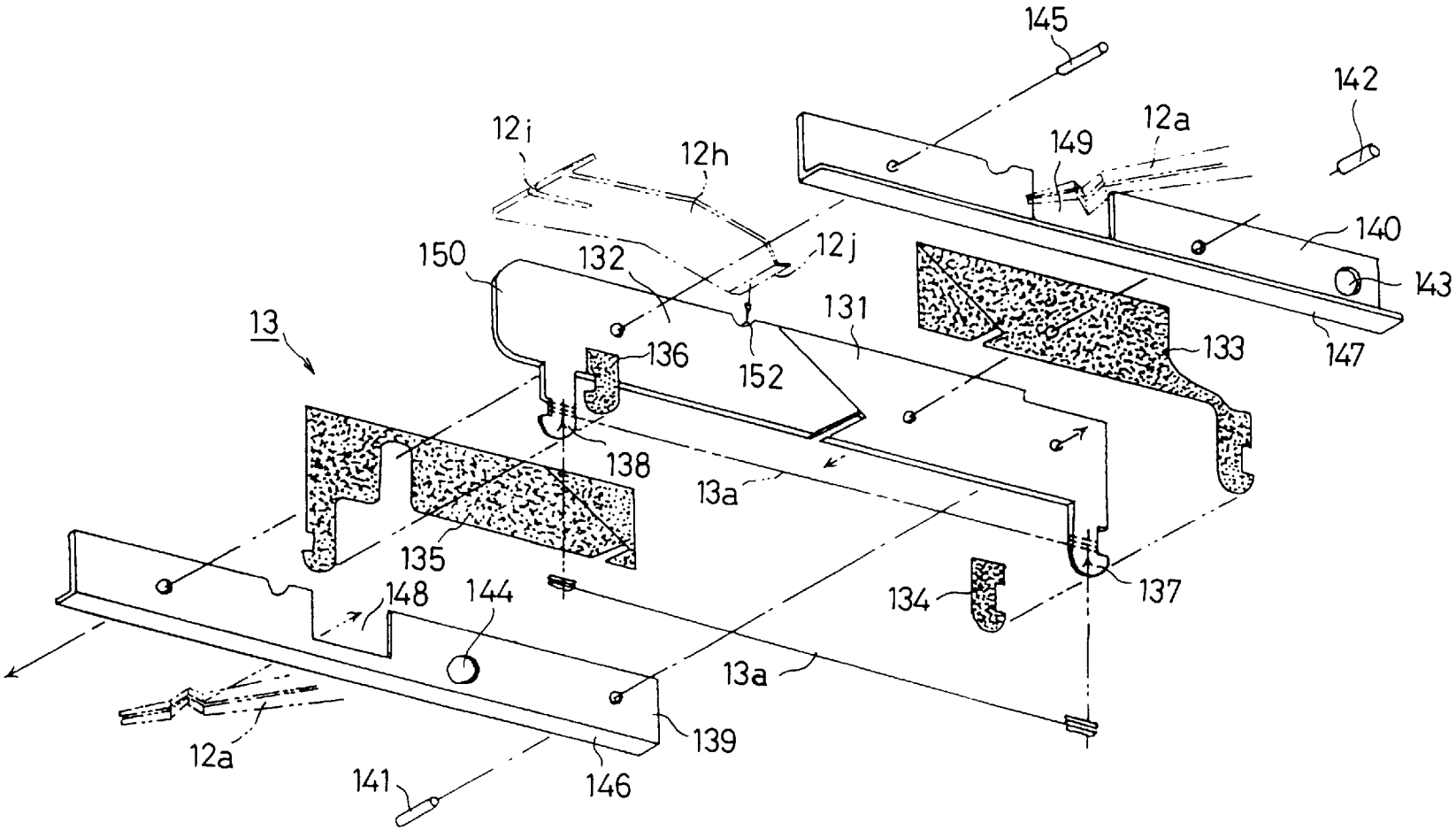
FIG. 18 is an exploded perspective view of a heater cartridge.

As may be seen in FIG. 18, the heater cartridge 13 is essentially comprised of front and rear substrates 131 and 132 which are split by a V-shaped line substantially at the center portion and which are made of an longitudinally elongated plate of an insulating material, conductor pattern layers (Cu) 133, 134, 135, 136 formed on the front and rear substrates 131 and 132, an electrical heating element (nichrome fine wire of 0.1 to 0.14 mmϕ in the illustrated embodiment) 13*a* which extends between the downward projection 137 provided on the front substrate 131 at the front end thereof and the downward projection 138 provided on the rear substrate 132 at the rear end thereof, and elongated side plates 139 and 140 that extend in the longitudinal direction to hold the front and rear substrates 131 and 132 therebetween and that have a generally L-shape cross section.

The front substrate 131 is made of a printed circuit board which is provided with the conductor pattern layers 133 and 134 that lie on the substantially entire right side surface thereof and on the projection 137 of the left side surface, respectively. The rear substrate 132 is made of a printed circuit board which is provided with the conductor pattern layers 135 and 136 that lie on the substantially entire left side surface thereof and on the projection 138 of the right side surface, respectively.

The front substrate 131 and the left side plate 139 are interconnected by caulking a pin 141 inserted in eyelets thereof. Likewise, the front substrate 131 and the right side plate 140 are interconnected by caulking a pin 142 inserted in eyelets thereof. Therefore, the front substrate 131 and the left and right side plates 139 and 140 are secured together by the pins 141 and 142.

In the illustrated embodiment, the left and right side plates 139 and 140 are made of a metal plate such as iron and the pins 141 and 142 are also made of a metal. To prevent the left and right side plates 139 and 140 from being electrically interconnected through the pins 141 and 142, the right side plate 140 is provided with a large pin receiving hole 143 so that the pin 141 which secures the front substrate 131 to the left side plate 139 does not contact with the right side plate 140. Likewise, the left side plate 139 is provided with a large pin receiving hole 144 so that the pin 142 which secures the front substrate 131 to the right side plate 140 does not contact with the left side plate 139. If the side plates 139 and 140 or the pins 141 and 142 are made of an insulating material, the large diameter pin receiving holes 143 and 144 are unnecessary.

The rear substrate 132, and the left and right side plates 139 and 140 are secured by means of a single insulated pin 145. The rear substrate 132 is rotatable in opposite directions (up and down) about the pin 145 between the left and right side plates 139 and 140.

The nichrome wire 13*a* is wound at its front and rear ends about the front projection 137 of the front substrate 131 and the rear projection 138 of the rear substrate 132, respectively and tensely extends therebetween. In the illustrated embodiment, the effective length of the nichrome wire 13*a* is 40–50 mm.

Figure 20:
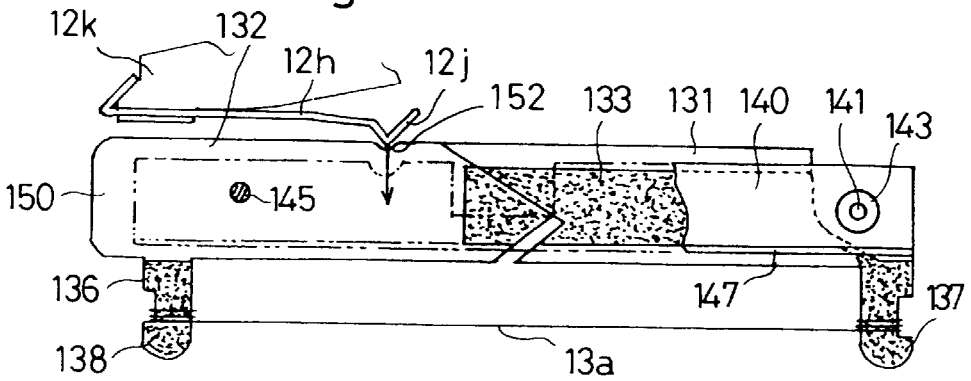
FIG. 20 is an explanatory view of a metal leaf spring acting on a heater cartridge.

The rear substrate 132 receives a rotation moment due to the tensile force of the nichrome wire 13*a*, and tends to rotate in the counterclockwise direction (upward) in FIG. 20 about the insulated pin 145. Consequently, the upper oblique surface of the V-convex shaped front end of the rear substrate 132 is pressed against the upper oblique surface of the corresponding V-recess shaped rear end of the front substrate 131 (FIG. 18).

The left and right comb tooth plates 11*a*, 11*a* of the implement body 11 are provided, on the inner walls of the spine portions thereof, with guide grooves 11*x*, 11*x* which extend in the longitudinal direction, so that guide projections 146 and 147 provided on the left and right side plates 139 and 140 of the heater cartridge 13 can be slidably fitted in the corresponding guide grooves 11*x*, 11*x*.

The heater cartridge 13 is inserted between the comb tooth plates 11*a*, 11*a* at the front end of the implement body 11, with the front substrate 131 located forward. During the insertion, the guide projections 146 and 146 are slid in the corresponding guide grooves 11*x*, 11*x*.

Figure 13A:
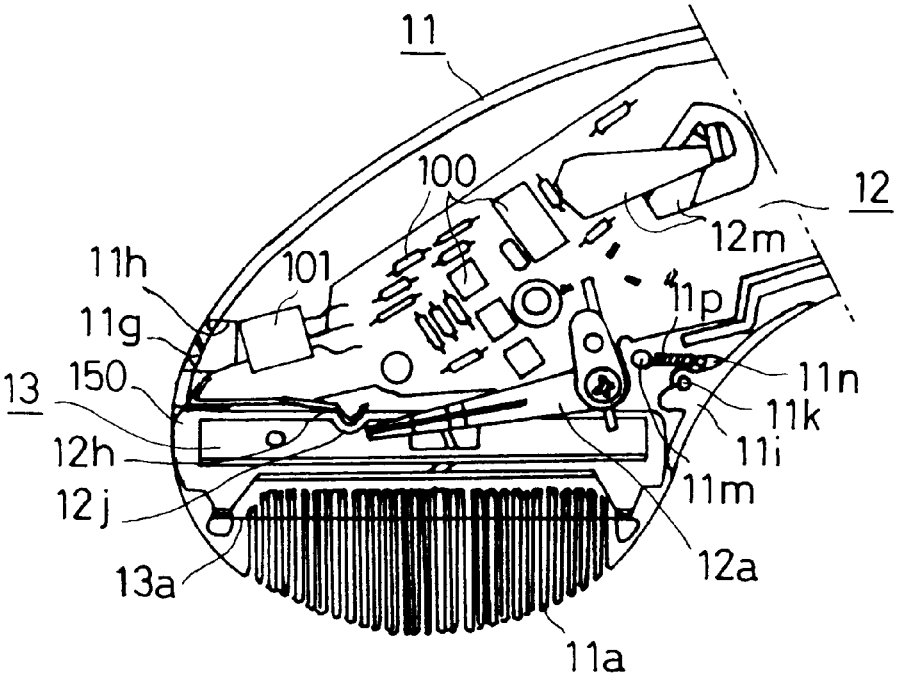
FIGS. 13*a* and 13*b* are plan views of an internal structure of an implement body having a heater cartridge attached thereto and an implement body in which a rear end of a heater cartridge is moved rearwardly by rotating a heater detachment lever, respectively.

When the heater cartridge is fully inserted in the implement body, the front ends of the electrical contact pieces 12*a*, 12*a* provided on the circuit board 12 are brought into press-contact with the conductor pattern layer 135 of the rear substrate 132 and the conductor pattern layer 133 of the front substrate 131, through recesses 148 and 149 formed in the left and right side plates 139 and 140 of the heater cartridge 13 to establish an electrical connection therebetween, respectively (FIG. 13*a*).

Figure 19:
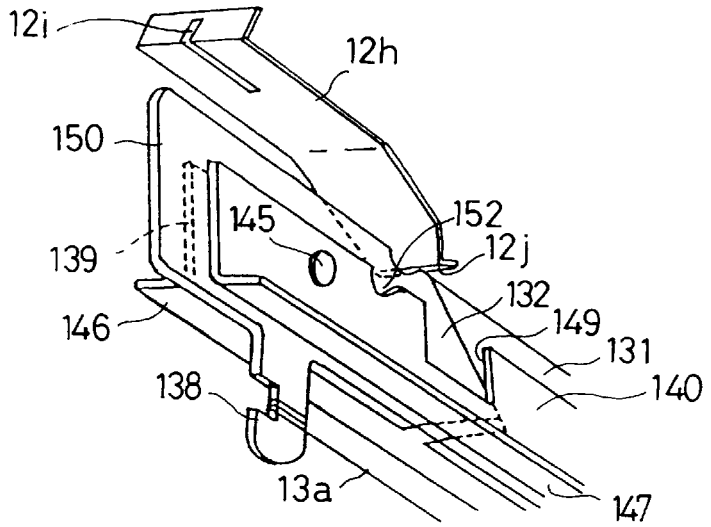
FIG. 19 is a perspective view of a rear end of a heater cartridge and a metal leaf spring as a tensing means.

The front end 12*j* of the metal leaf spring 12*h* as a tensing means provided on the circuit board 12 at the front end thereof is brought into contact with a recess 152 formed on the rear substrate 132 of the heater cartridge 13, so that the rear substrate 132 is biased to rotate in the clockwise direction in FIG. 20 about the pin 145 against the tensile force of the nichrome wire 13*a* (FIG. 13*a*, FIGS. 19 and 20).

Consequently, in the state that the heater cartridge 13 is mounted to the implement body 11, the nichrome wire 13*a* extends tensely adjacent to base ends of the comb teeth of the comb tooth plates 11*a* and between the comb tooth plates 11*a*, 11*a* that are spaced from one another at a distance "w".

When the switch button 11*e* is depressed to turn the power supply circuit ON in the state that the heater cartridge is mounted to the implement body, the electric current flows in one of the electric contact pieces 12*a*→the conductor pattern layer 135→the nichrome wire 13*a*→the conductor pattern layer 133→the other electric contact piece 12*a* (and vice versa).

Figure 21:
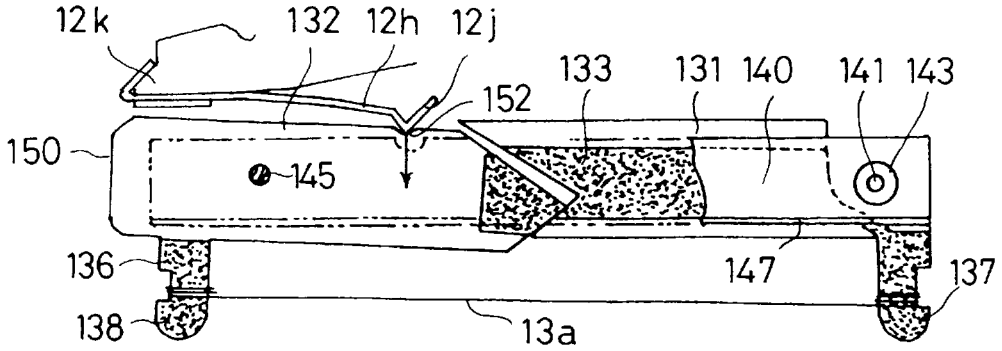
FIG. 21 is an explanatory view of a metal leaf spring acting on a heater cartridge shown in a position different from a position shown in FIG. 20; and, FIG. 22 is a schematic view of a rigid rod or tubular body as a heating element.

The nichrome wire 13*a* extending between the front projection 137 of the front substrate 131 and the rear projection 138 of the rear substrate 132 is elongated due to the linear expansion when it generates heat. As a result of the elongation, the rear substrate 132 is rotated about the pin 145 in the clockwise direction in FIGS. 20 and 21 by the metal leaf spring 12*h* (tensing means). Consequently, the distance between the front and rear projections 137 and 138 between which the nichrome wire 13*a* extends is increased, so that the elongation (looseness) of the nichrome wire 13*a* can be absorbed. Thus, the nichrome wire 13*a* is always kept in a tensed state (FIG. 21).

Figure 13B:
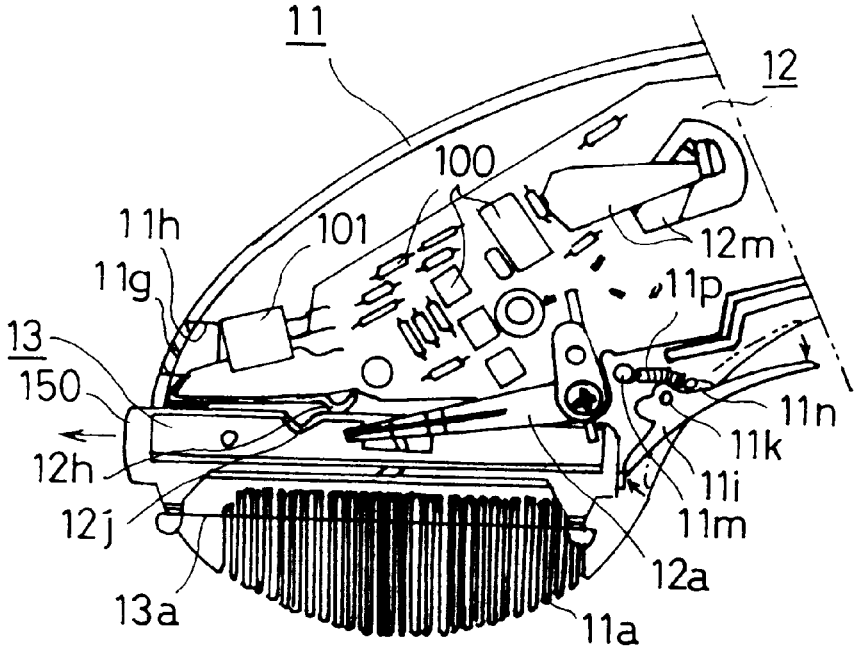

If the nichrome wire 13*a* is broken, the heater cartridge detaching lever 11*i* is manually rotated in the clockwise direction about the post 11*k* against the coil spring 11*p* as shown in FIG. 13*b*. Consequently, the attached heater cartridge 13 is pressed downward at the front end thereof by the rotating lever 11*i*. Thus, the rear end (grip portion) 150 of the rear substrate 132 is protruded out of the front ends of the comb tooth plates 11*a*.

Thereafter, the operator holds the grip portion 150 with his or her fingers and pulls the heater cartridge in the direction opposite to the insertion direction to remove the heater cartridge from the space between the comb tooth plates. Thereafter, a new heater cartridge 13 can be inserted in the implement body.

Other Operations

The circuit board 12 is not limited to a printed circuit board and can be replaced with other substrates.

The electric heating element 13*a* is in the form of a line or rod extending between the power supplying electrodes. The line of rod can be comprised of a heating element which is electrically connected to the power supplying electrodes and an insulator (outer shell) which houses therein the heating element, wherein when the insulator is heated by the heat generated by the heating element so that the insulator indirectly generates heat, no or little elongation or contraction due to the linear expansion is caused thereby. With this arrangement, it is not necessary to provide a means for tensing the electric heating element, thus resulting in a simplification of the structure.

Figure 22:
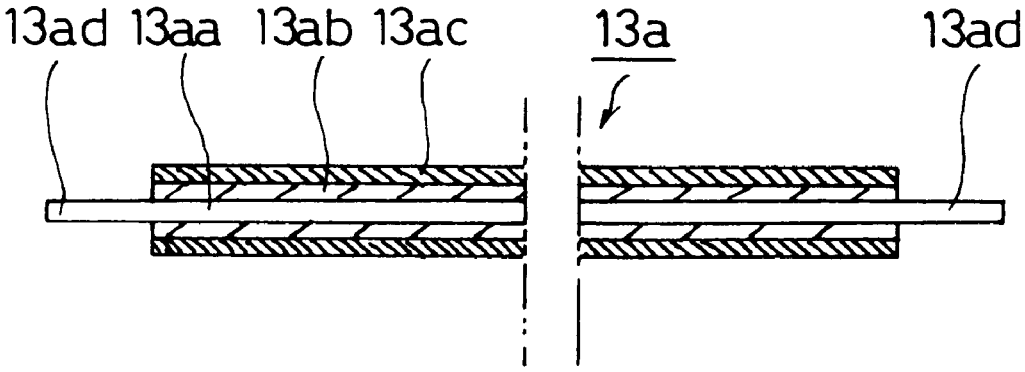

FIG. 22 shows an example of such heating element 13*a*. The heating element 13*a* is comprised of a rigid thin rod or tube a core (heating wire) 13*aa* made of nichrome fine wire whose diameter is in the range of 0.1 to 0.14 mm ϕ, and a tubular body 13*ac* of nickel (formed by, for example, drawing) which is provided on its inner surface with an insulator 13*ab* of, for example, alumina. The core 13*aa* is inserted or embedded in the insulator 13*ab*. The leading ends 13*ad*, 13*ad* of the nichrome wire 13*aa* extend outward from the tubular body 13*ac* and are connected to the power supply electrodes. The total thickness of the tubular body 13*ac* and the insulator 13*ab* is in the range of 0.2 to 0.4 mm.

The power supply system is not limited to the external power supply system using an external power source, in which the power is supplied to the implement from the commercial power source through the DC converter 14. The internal power supply system in which a dry battery or storage battery is incorporated in the implement body can be also used.

The present invention is not limited to a hair treating implement using a detachable heater cartridge having an electric heating element and can be applied to a hair treating implement having a built-in heating element.

As can be understood from the foregoing, according to the present invention, since the electric contact pieces which are brought into contact with the heater cartridge attached to the implement body to supply the electrical power to the electric heating element of the heater cartridge from the implement body are provided on the circuit board arranged in the implement body and are electrically connected to the electronic circuit of the circuit board, the contact pieces can be arranged in the implement body together with the circuit board.

Consequently, no separate placement or wiring operation of the contact pieces is necessary. In addition, there is no fear of a wiring error. Furthermore, no wiring operation is needed in the manufacturing process of the hair treating implement. This effect is the same as that expected from the printed circuit board.

Since the tensing means for tensing the heating element of the heater cartridge attached to the implement body is attached to the circuit board arranged in the implement body, the tensing means can be automatically arranged in the implement body when the circuit board is arranged in the implement body.

Consequently, no separate placement of the tensing means is necessary. Hence, there is no fear that the tensile force by the tensing means is weakened due to a placement error. Furthermore, assembling operation can be simplified. This effect is also equivalent to that of the printed circuit board.

Since the electrical contact pieces for the ON-OFF switches for switching the power supply to the heater cartridge attached to the implement body is attached to the circuit board arranged in the implement body and is electrically connected to the electronic circuit of the circuit board, the contact pieces can be automatically arranged in the implement body when the circuit board is arranged in the implement body.

Consequently, no separate placement or wiring of the electrical contact pieces for the ON^OFF switches is necessary. Hence, there is no fear of a wiring error. Furthermore, no wiring operation is needed in the manufacturing process of the hair treating implement. In the prior art, the switch provided on the substrate or circuit board is used, but the contact pieces for the switch are not provided on the circuit board or substrate. The number of the manufacturing process and the number of the components can be reduced in the present invention.

Since the power receiving connector which can be electrically connected to the external power source is attached to the circuit board arranged in the implement body and is electrically connected to the electronic circuit of the circuit board, the power receiving connector can be automatically arranged in the implement body when the circuit board is arranged in the implement body.

Consequently, no separate placement or wiring of the power receiving connector is necessary. Hence, there is no fear of a wiring error. Furthermore, no wiring operation is needed in the manufacturing process of the hair treating implement. In the prior art, the connector provided on the substrate or circuit board is used, but the contact pieces for the connector are not provided on the circuit board or substrate. The number of the manufacturing process and the number of the components can be reduced in the present embodiment.

In the present embodiment, the electrical contact pieces which are adapted to supply the power to the electrical heating element, the tensing means for tensing the electrical heating element, the electrical switching contact pieces for switching the power supply to the electrical heating element, and the power receiving connectors which can be connected to the external power source are provided on the circuit board to be arranged in the implement body. Consequently, when the circuit board is arranged in the implement body, all the above mentioned components can be arranged together in the implement body. Therefore, no individual placement or wiring of the internal components is necessary. Also, there is no wiring error.

The present invention is not limited to a hair treating implement using a detachable heater cartridge having an electric heating element and can be applied to a hair treating implement having a built-in heating element.

According to the present invention, the assembling operation or the wiring operation can be simplified or eliminated, and thus not only can the yield of the parts or products be increased, but also the manufacturing cost can be reduced. Consequently, the high quality and inexpensive products can be produced.

What is claimed is:

1. A body hair treating implement comprising:

a pair of opposed and spaced comb tooth plates, each having teeth extending from a base toward tip ends; and an electrical heating element which is provided between the comb tooth plates and is brought into contact with body hair combed by the comb teeth of the comb tooth plates, so that when the electrical heating element is supplied with electrical power, the heating element generates heat to burn and cut the body hair in contact therewith;

wherein the opposed comb teeth of the opposed comb tooth plates are at least partially interconnected at said tip ends in the form of an arch, said tip ends being disposed adjacent a crown of said arch.

2. A body hair treating implement including a pair of opposed and spaced comb tooth plates and an electrical heating element which is provided between the comb tooth plates and is brought into contact with body hair combed by the comb teeth of the comb tooth plates, so that when the electrical heating element is supplied with electrical power, the heating element generates heat to burn and cut the body hair in contact therewith, wherein the comb teeth of at least one of the opposed comb tooth plates are at least partly bent inward at their tip ends toward the corresponding comb teeth of the other comb tooth plate.

3. A body hair treating implement according to claim 1, wherein said comb tooth plates are integrally formed as a comb tooth unit which can be detachably attached to an implement body.

4. A body hair treating implement according to claim 2, wherein distance between tip ends of said pair of comb tooth plates are being set between 0.5–1.0 mm.

* * * * *